US007013019B2

(12) United States Patent
Cox et al.

(10) Patent No.: US 7,013,019 B2
(45) Date of Patent: Mar. 14, 2006

(54) THERMOSET COMPOSITE MATERIAL BAFFLE FOR LOUDSPEAKER

(75) Inventors: David H. Cox, Chatsworth, CA (US); Bernard M. Werner, Los Angeles, CA (US); Mary Vosse, Santa Clarita, CA (US)

(73) Assignee: Harman International Industries, Inc., Northridge, CA (US)

( * ) Notice: Subject to any disclaimer, the term of this patent is extended or adjusted under 35 U.S.C. 154(b) by 314 days.

(21) Appl. No.: 10/093,878

(22) Filed: Mar. 7, 2002

(65) Prior Publication Data

US 2003/0002702 A1 Jan. 2, 2003

Related U.S. Application Data

(60) Provisional application No. 60/273,883, filed on Mar. 7, 2001.

(51) Int. Cl.
*H04R 25/00* (2006.01)

(52) U.S. Cl. ..... 381/386; 381/339; 381/395

(58) Field of Classification Search ..... 381/334, 381/335, 336, 337–340, 342, 345, 347, 350, 381/353, 161, 162, 164, 182, 386, 395; 181/144, 181/148, 155, 156, 184, 150
See application file for complete search history.

(56) References Cited

U.S. PATENT DOCUMENTS

| | | | | |
|---|---|---|---|---|
| 3,969,178 A | | 7/1976 | Jeanson | 156/361 |
| 3,979,539 A | | 9/1976 | Jeanson | 428/126 |
| 3,988,290 A | | 10/1976 | Uffner | 260/40 |
| 4,219,524 A | | 8/1980 | Miller | 264/216 |
| 4,239,808 A | | 12/1980 | Arnason | 428/482 |
| 4,289,684 A | | 9/1981 | Kallaur | 260/40 |
| 4,294,144 A | | 10/1981 | Hayes | 83/71 |
| 4,327,145 A | | 4/1982 | Mitani et al. | 428/290 |
| 4,339,490 A | | 7/1982 | Yoshioka et al. | 428/213 |
| 4,367,192 A | | 1/1983 | Arnason | 264/255 |
| 4,444,829 A | | 4/1984 | Bollen et al. | 428/220 |
| 4,474,845 A | | 10/1984 | Hagerman et al. | 428/283 |
| 4,511,424 A | | 4/1985 | Usui | 156/426 |
| 4,524,846 A | * | 6/1985 | Whitby | 181/152 |
| 4,537,091 A | | 8/1985 | Kulkarni et al. | 74/572 |
| 4,557,889 A | | 12/1985 | Masuda et al. | 264/320 |
| 4,568,505 A | | 2/1986 | Bollen et al. | 264/171 |
| 4,571,320 A | | 2/1986 | Walker | 264/40.1 |
| 4,959,189 A | | 9/1990 | Rohrbacher et al. | 264/510 |
| 5,001,000 A | | 3/1991 | Rohrbacher et al. | 428/215 |
| 5,001,193 A | | 3/1991 | Golden | 525/109 |
| 5,067,583 A | | 11/1991 | Hathaway | |
| 5,100,935 A | | 3/1992 | Iseler et al. | 523/514 |
| 5,126,085 A | | 6/1992 | Thorp et al. | 264/112 |
| 5,268,400 A | | 12/1993 | Iseler et al. | 523/514 |
| 5,356,953 A | | 10/1994 | Harada et al. | 523/171 |
| 5,431,995 A | | 7/1995 | Narita et al. | 428/287 |
| 5,726,395 A | | 3/1998 | Anagnos | 181/141 |
| 5,985,391 A | | 11/1999 | Denehy et al. | 428/36.6 |
| 6,001,919 A | | 12/1999 | Yen et al. | 524/496 |
| 6,023,515 A | | 2/2000 | McKee et al. | 381/150 |
| 6,103,032 A | | 8/2000 | Greve | 156/62.2 |
| 6,119,750 A | | 9/2000 | Greve | 156/382 |
| 6,173,064 B1 | | 1/2001 | Anagnos | 381/353 |

* cited by examiner

*Primary Examiner*—Suhan Ni

(57) ABSTRACT

This invention provides a baffle formed from a thermoset composite material such as Bulk Molding Compound (BMC), Thick Molding Compound (TMC), or Sheet Molding Compound (SMC). Due to the physical properties of BMCs, TMCs, and SMCs, the baffle may be molded to minimize the propagation of vibrational energy and resonant mode behavior while providing high strength and rigidity. The baffle may also be formed so transducer mounts, ports and wave-guides may be molded into the baffle shape.

46 Claims, 3 Drawing Sheets

THERMOSET COMPOSITE MATERIAL BAFFLE FOR LOUDSPEAKER

CROSS-REFERENCES TO RELATED APPLICATIONS

This application claims priority from a provisional application having application Ser. No. 60/273,883 that was filed on Mar. 7, 2001, and is incorporated by reference.

BACKGROUND OF THE INVENTION

1. Field of the Invention

This invention provides a baffle configured to enclose a speaker enclosure that is capable of minimizing propagation of vibrational energy and resonant mode behavior while providing high strength and rigidity.

2. Related Art

Loudspeakers are devices that can convert electrical signals into acoustical energy using transducers. Loudspeakers typically include a front baffle comprising an enclosure. Located within the enclosure is at least one transducer. The outer frame of the transducer may be made of metal or plastic. As the voice coil moves back and forth to create the acoustical sounds, vibrations created from movement of the voice coil often is radiated to the walls of the loudspeaker enclosure by the transducer frame. These vibrations often propagate freely throughout the enclosure exciting panel resonance. The re-radiation of energy is undesirable because it can be perceived as distortion and coloration of the primary signal in the frequency range between 20 Hz to 20 kHz. The re-radiation energy may occur at certain frequencies called re-radiation points or resonant modes. These points or modes may act as undesired phantom sound sources that can compromise the sound field imaging capabilities of the loudspeaker.

Several approaches have been taken to address the problems of panel resonance and re-radiation of energy such as: (1) using a "soft" mounting system to decouple the transducer from the front baffle; (2) adding internal bracing and increasing wall rigidity to increase the frequency of panel resonant modes; (3) adding extensional damping materials and compounds to the interior surfaces of the cabinet walls to damp the internal vibrational energy; and (4) casting the front baffle from energy absorbing materials. All of these approaches, however, have their own limitations.

Using a soft mount system is undesirable because it prevents the transducer from utilizing the overall mass of the loudspeaker cabinet to minimize unwanted motion of the transducer frame. When a soft mounting system is used between the transducer and the loudspeaker cabinet, a loss in perceived fidelity may result from movement of the transducer relative to the enclosure. This loss of perceived fidelity is particularly noticeable in low frequency.

Adding internal bracing and stiffening of the enclosure wall may push the panel resonant modes to higher frequencies where they may cause less audible damage. This, however, may be inadequate because the resonant modes may still exist at higher frequencies. Also, internal bracing and stiffening of the enclosure walls increases the weight of the loudspeaker. This makes it more difficult to handle and transport the loudspeaker.

Adding external damping materials or compounds to the inside of the enclosure is generally only effective in dampening in the high frequency range. The thickness and composition of the damping material may be critical, and at least 50% of the surface area of the interior walls may need to be covered to be effective. Accordingly, adding dampening material adds cost and time to manufacture the loudspeaker.

Casting a baffle from an acoustically "dead" material is problematic because attaching a heavy baffle to the loudspeaker cabinet can compromise the mechanical integrity of the overall loudspeaker. The heavy baffle usually also requires a complicated system of gaskets and screws to enclose the baffle over the cabinet, and because of added weight; it can be more difficult to handle and transport.

Accordingly, there is a need for a baffle that is easy to manufacture and minimizes distortion of the sound being generated by the transducer. Additional needs include providing a baffle that is impact resistant, has sufficient rigidity or stiffness, and optimizes the special separation between the high frequency horn and the woofer.

SUMMARY

This invention provides a baffle formed from thermoset composite materials such as polyester resins. These resins are useful for minimizing the propagation of vibrational energy and resonant mode behavior. Additional benefits include high strength, rigidity, damping characteristics, and impact resistance. Examples of various thermoset composite materials include Bulk Molding Compound (BMC), Thick Molding Compound (TMC), and Sheet Molding Compound (SMC).

The baffle may be formed so transducer mounts, ports, and wave-guides may be molded into the baffle shape. Use of thermoset composite materials allows the baffle design to be shaped such that the high frequency wave-guide may be optimally spaced from the woofer. By forming the transducer mounts, ports, and horns into the baffle shape, baffle size and number of components may be reduced, thus lowering manufacturing costs.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
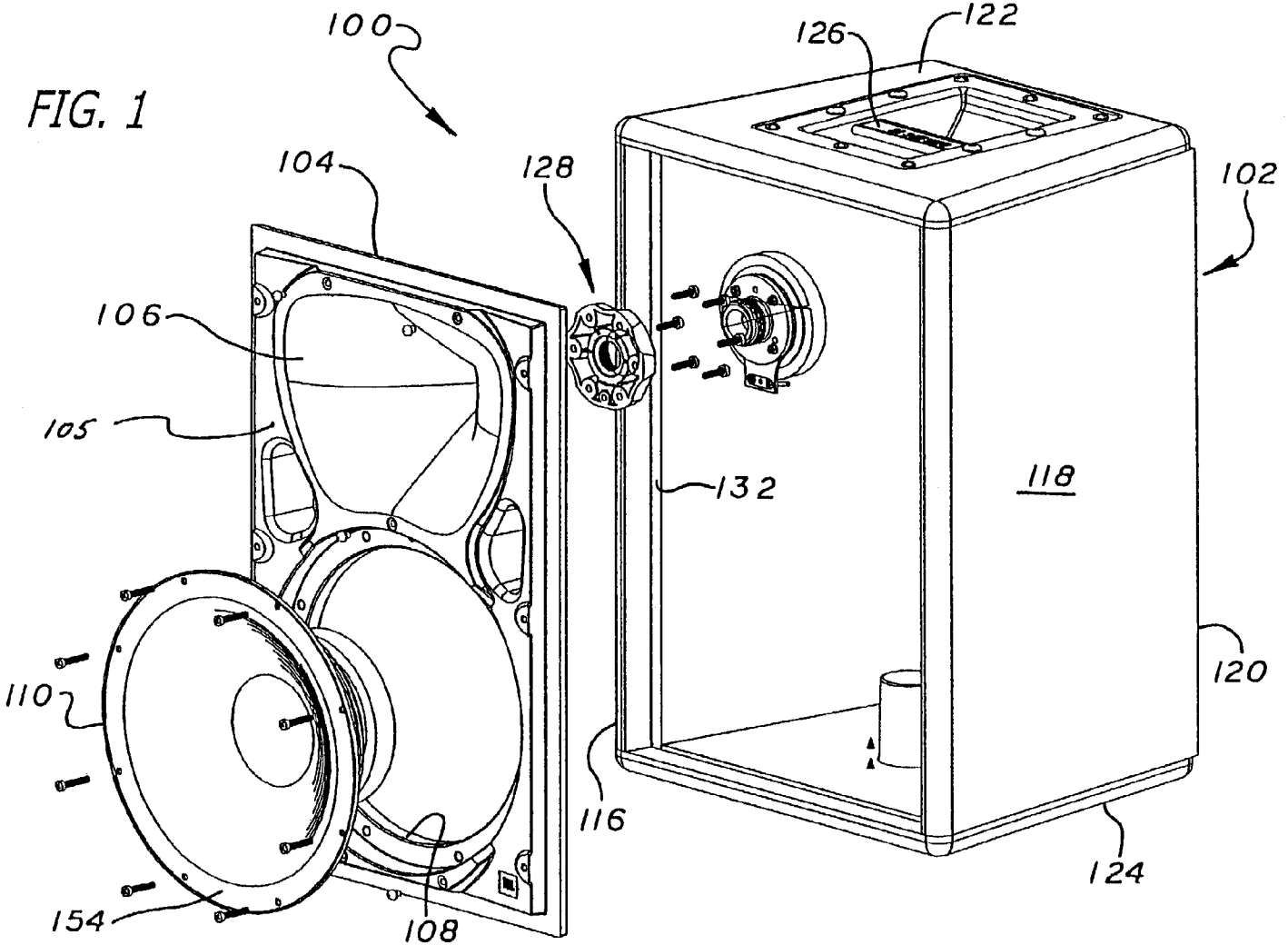
FIG. 1 is a perspective view of a baffle and a loudspeaker enclosure.

FIG. 1 illustrates an exploded perspective view of a loudspeaker system 100 having a baffle 104 adapted to substantially enclose an enclosure 102. The baffle 104 may be formed from a thermoset composite material to minimize the propagation of vibrational energy and resonant mode behavior while providing high strength and rigidity. The baffle 104 may be molded from thermoset composite material with a high frequency wave-guide 106. The throat end of the high frequency wave-guide 106 may be to couple to a high frequency compression driver 128. The baffle 104 has a front face 105 with an opening 108 for mounting a woofer transducer 110. The woofer transducer 110 may be secured to the opening 108 with a frame 154 using screws around the perimeter of the frame. The excursion of the driver 128 and the transducer 110 transmit vibrational energy throughout the baffle 104 and the enclosure 102.

The enclosure 102 may have sidewalls 116, 118, a rear wall 120, a top wall 122, and a bottom wall 124 secured together to define a space within the enclosure 102. The enclosure 102 may house a high frequency driver, a woofer transducer 110, and various electrical components such as crossover networks (not shown). The top wall 122 may include a handle 126 to allow easy transport of the loudspeaker system 100. The walls 116, 118, 120, 122, and 124 may be formed from composite materials, plastics, metal, wood or wood by-products such as particleboards and medium density fiberboard (MDF) or any other materials that exhibits adequate rigidity and damping characteristics. The enclosure 102 may also be molded from thermoset composite material.

The baffle 104 may be sized and configured to rest on a ledge 132 around the inner perimeter of the front side of the enclosure 102. The baffle 104 may be secured to the enclosure 102 with fasteners such as screws and/or an adhesive to substantially enclose the enclosure 102. The combination of the baffle 104 and the enclosure 102 may form a seal around the perimeter enclosure 102.

Figure 2:
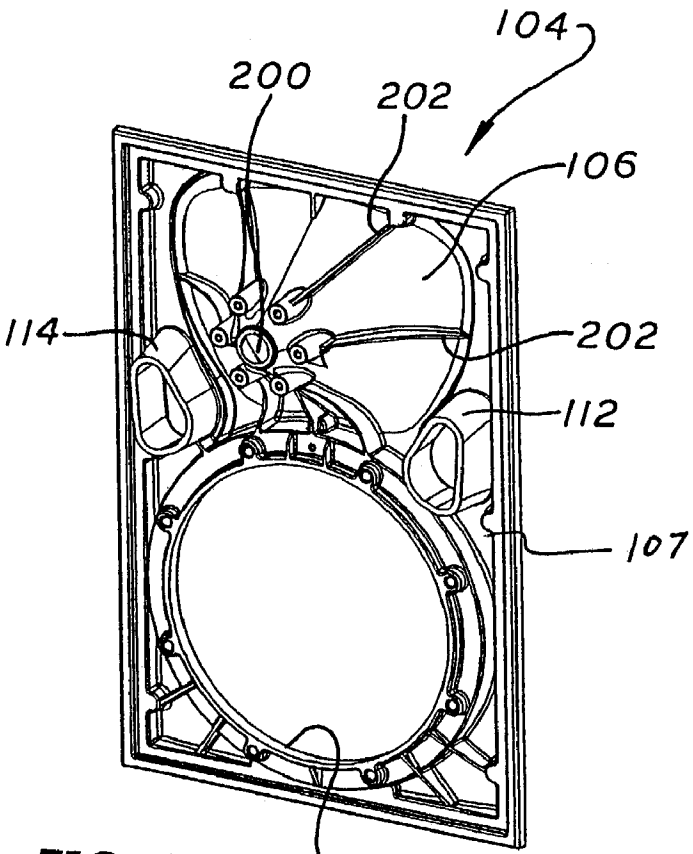
FIG. 2 is a rear perspective view of the baffle shown in FIG. 1.

FIG. 2 illustrates the backside 107 of the baffle 104 that has been molded into shape with a high frequency wave-guide 106. This way, the baffle 104 and the wave-guide 106 may be integral rather than being separate and mounted together. The throat 200 of the high frequency wave-guide 106 may couple to a high frequency compression driver 128. Two port tubes 112 and 114 may be integrally molded with the baffle 104 as well. This way, the baffle 104 may be molded with the wave-guide 106, the opening 108, and the port tubes 112 and 114 to save time and cost of manufacturing the baffle 104.

Figure 3:
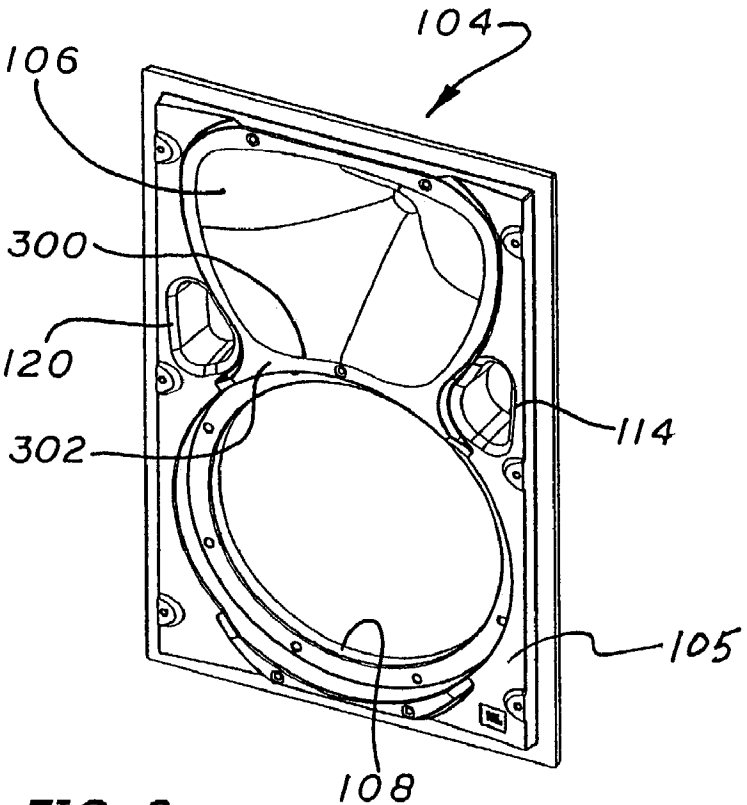
FIG. 3 is a front perspective view of a baffle.

FIGS. 2 and 3 also illustrate that the strength to weight ratio of the baffle 104 may be improved by adding material where it is needed, or curving the weak areas of the baffle 104 for added strengthen. For example, the front face 105 of the baffle 104 may have a thin area 302 between the wave-guide 106 and the opening 108 that may be subject to high stress from the transducer 110 vibrating back and forth. The thin area 302 may be strengthen using ribs 202 on the backside 107 of the baffle. The weak area 302 may be further stiffened by curving the outline portion 300 of the front face 105 near the opening 108. This way, the weak areas of the baffle 104 may be strengthen using ribs 202 and/or shaping the front face 105 with curves to strengthen the weak areas.

The baffle 104 may be molded to incorporate any combination of transducers and drivers such as one low frequency, one mid range, and one high frequency transducers. The high frequency compression driver 128 may operate above 1 kHz, the woofer transducer may operate below 3 kHz, and a mid range transducer may operate between about 300 Hz to about 3 kHz.

The baffle 104 may be molded using a thermoset composite material. Thermoset composite materials typically describe materials exhibiting cross-linking properties during the curing process so that once it is fully cured it cannot be re-melted. Thermoset composite materials include a thermosetting resin and reinforcement. Thermosetting resin may be a polyester or vinylester resin in a styrene monomer form. The reinforcement may be in the form of fiberglass with some lengths of 0.05 inches to about 2.0 inches. The reinforcement material typically comprises between about 15% and about 66% by weight of the thermoset composite material. Additional filler(s) and additive(s) may be added during the process to obtain a desired quality in the thermoset composite material to affect the surface of the molded material or to add strength or stiffness to the formed part. The James E. Rinz references U.S. Pat. Nos. 6,040,391 and 5,854,317 both entitled "Process for Thickening Thermoset Resin Molding Compound Compositions" are incorporated by reference.

Various thermoset composite materials may be used to form a baffle. These thermoset composite materials may include thick molding compounds (TMC), bulk-molding compounds (BMC), and sheet-molded compounds (SMC). These composite materials may also include additional fillers such as rubber, glass, calcium carbonate, mica, sawdust and other known filler materials. In an example embodiment, using a glass filler of less than 30% on a high cosmetic grade surface type parts. However, a typically range of overall glass content may contain between 15%–66% by weight. The use of aluminum trihydrate may act as a fire retarding material. Mold releasing agents and colorizing agents may also be included for easier removal from the molds and to provide the optimal color of the finished product.

Also, various processes may be used to form the baffle. These processes may include compression molding, injection molding, two-shot injection molding, reaction injection molding, and vacuum or pressure thermoforming.

BMC is typically delivered to manufacturers in a bulk form and not in sheet form. In a bulk form, there is typically no glass filler orientation control. Therefore, in the formed product, areas of heavy glass and light glass can be encountered. Also, other variables in the distribution of additives may exist in BMC compounds. BMC may include use of additional fillers and reinforcement with short fibers. BMC may be produced in bulk form or extruded into rope or billets, and it can be used in transfer, compression, or injection molding process. SMC may be produced in sheet form and reinforced with long fibers.

SMC may include thin sheets of polyester resin, glass, and polyester resin sandwiches. Typically, the top and bottom of the thin sheets are loaded with various fillers. When glass is used as the filler, the glass may be orientated between the two sheets. When calcium carbonate is used as the filler, the specific gravity typically does not exceed 1.85 gms/sq. cm.

TMC may be highly filled with fillers and reinforced with intermediate-length fibers. TMC may be available in slab, heavy sheet, or rolled form. TMC may combine the flowability of BMC and the mechanical properties of SMC, and molded using injection, transfer, or compression molding process. TMC may also include thin sheets of polyester resin, glass, and polyester resin sandwiches. Typically, the top and bottom of the thin sheets are loaded with various fillers, but the top and bottom sheets are thicker allowing for more additive placement by weight. Additional fillers may include mica or the more commonly used calcium carbonate providing larger quantities of calcium carbonate located on the top and bottom thickness layers. Such as arrangement produces a specific gravity close to 2.0 gms/sq. cm.

The baffle 104 may be molded using a thermoset composite material to improve the acoustic properties of the baffle 104. The characteristics of certain thermoset composite material may be described in terms of dampening factor Q that is a measure of the degree of damping of a resonant peak of displacement vs. frequency in the forced response of a material. To measure Q of a material, a swept sine wave from a nearby acoustic source may excite a testing material. Then using a laser displacement measurement system, the displacement of the testing material may be measured as a function of frequency being used. The peak resonant frequency may be determined along with the frequencies above and below the resonant peak where the response is −3 db from the peak. The damping factor Q may be expressed as: Q=F resonant/(F upper−F lower).

Alternatively, the standard set forth by the American Society for Testing and Materials (ASTM), designation E 756-93, entitled "Standard Test Method for Measuring Vibration-Damping Properties of Materials," may be used to measure the damping properties of materials. Note that a material with a lower Q is a better damping material than a material with a higher Q. Although a low damping factor Q is desirable, a material exhibiting a low damping factor usually exhibits the undesirable characteristics of low rigidity and strength. The rigidity and strength of a material may be determined by measuring the Youngs Modulus (YM). For example, wood is generally considered a good damping material having a Q of about 36. On the other hand, wood has YM of about 439K so that wood may not be stiff enough to resist the wall movement from a low frequency transducer vibrating.

Figure 4:
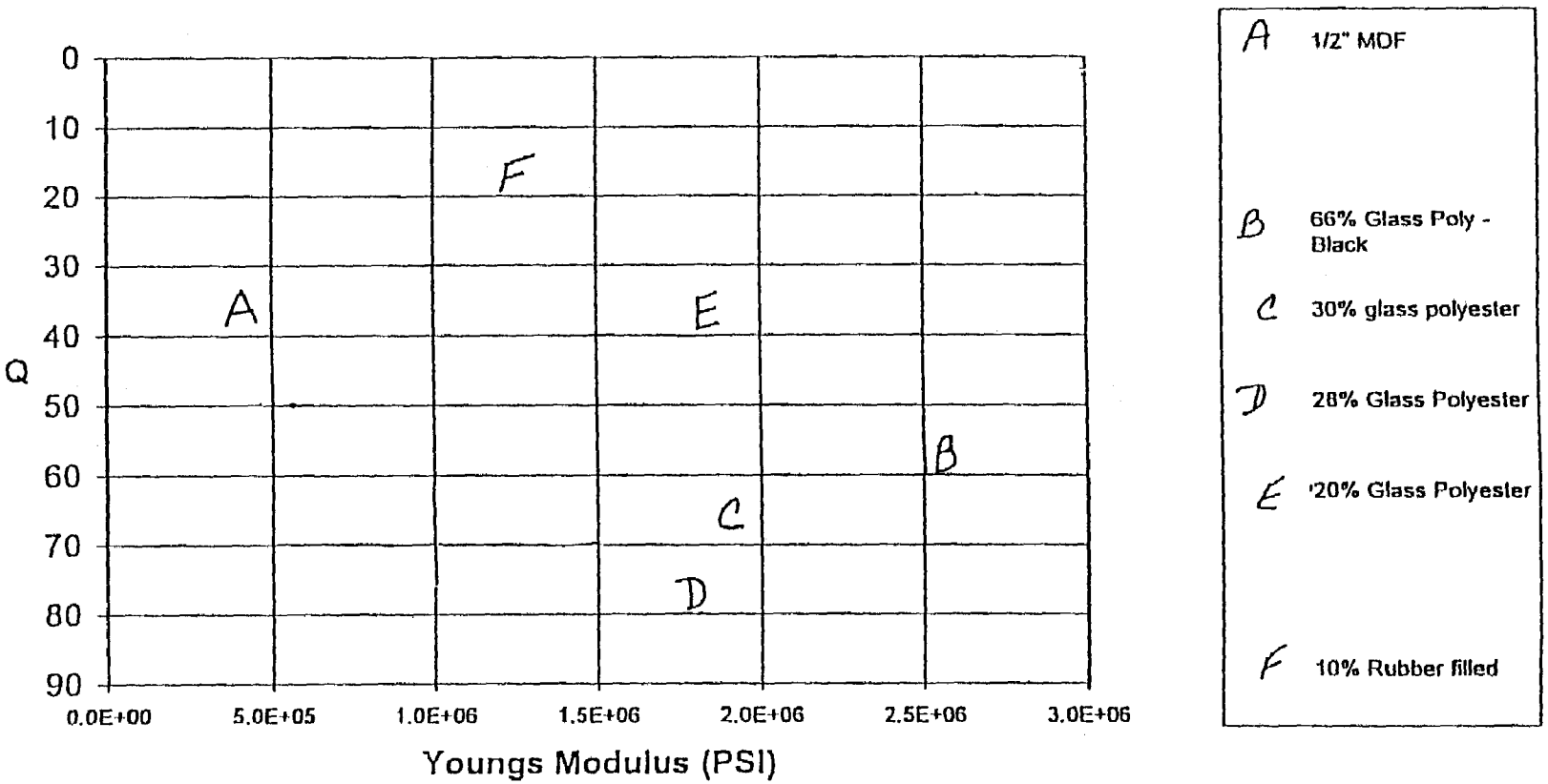
FIG. 4 is a graph illustrating damping factor Q and Youngs Modulus for various materials.

For comparison purposes, FIG. 4 illustrates a table with a graph of damping factor Q and Youngs Modulus for comparing a number of materials including: (1) TMC; (2) SMC; and (3) Medium Density Fiberboard (MDF). The MDF is ½ inch wood by product that is commonly used to manufacture baffles. MDF is marked as "A." The SMC with 20% by weight of glass polyester is marked as "E." And the TMC with 10% by weight of rubber filler is marked as "F." his example is not suggestive of the preferred embodiment but instead merely illustrative of the Young's Modulus and Q for thermoset composite materials and wood based products. In actual formulation, the percent of fillers of additives is dependent upon the ultimate characteristics desired in the final product. The range of percentages of fillers, releasing agents and coloring agents varies significantly and may be optimized to achieve specific characteristics of the final formed product.

TABLE 1

| | TMC | SMC | MDF (wood) |
|---|---|---|---|
| ADDITIVES | 10% rubber | 20% glass polyester | N/A |
| YM | 1.19 M PSI | 1.75 M PSI | 0.43 M PSI |
| Q | 16 | 41 | 36 |

MDF is used for manufacturing baffles because of its relatively low damping factor Q of 36. MDF, however, has a relatively low YM of about 0.4 M PSI (400K PSI). This means that MDF may not be stiff enough to handle the re-radiation energy produced by the transducer. In contrast, TMC has a damping factor Q of about 16 and an YM of about 1.19 M PSI. This means that TMC has a better dampening characteristic than MDF to reduces mechanically and/or acoustically induced vibration. TMC is also stiffer than MDF so that TMC dissipates shock and impact energy more quickly than MDF. Another desirable quality of TMC is that it may be relatively inert to environmental conditions such as humidity, ultra violet sunlight, and temperature. TMC having between about 1% and 15% by weight of rubber filler may be used for molding a baffle.

SMC with 20% glass polyester (E) has a dampening factor Q of about 41 that is greater than MDF's dampening factor Q, and this SMC's YM is about four times greater than MDF's YM. Other SMCs with 28% (marked as "D"), 30% (marked as "C"), and 66% (marked as "B") of glass polyester by weight may have greater Q and YM than MDF. SMCs with higher YM provide good stiffness to handle the re-radiation energy produced by the transducer. With regard to Q, a material having Q of less than about 55 may have acceptable dampening characteristics for use in a baffle, but materials having Q of greater than 55 may be used as well. Accordingly, a baffle may be molded using thermoset composite materials such as SMC and TMC, and provide the dampening and stiffness characteristics needed for a baffle. Besides 20% by weight of glass, SMC having at least about 10% by weight of glass may be used for molding a baffle. Molding the baffle also allows the designer to improve the strength to weight ratio of the baffle and incorporate the wave-guides and ports into the design. Besides molding baffles, thermoset composite materials may be used to mold the enclosure 102 to improve its dampening and stiffness characteristics.

A variety of methods may be used to mold the baffle such as: compression molding, injection molding, heat molding, and exothermic reaction molding. For example, thermoset composite material may be spread on a cutting table, the edge trim may be removed, and the remaining material may be sliced into pieces of predetermined size, shape, and weight. The cut pieces may be assembled and stacked into a charge pattern in the optimum shape and volume to fill the mold cavity of a compression mold, for example. The charge may be placed on the heated mold surface in a predetermined position. For more complicated configured baffle, the charge may be placed into the mold in sections. To reduce air entrapment, charges may be pyramided (small charges stacked upon one another). The mold, generally steel tooling, may be heated to 275°–310° F. and closed, compressing the thermoplastic charge. The pressure applied to the mold may be about 800–1200 PSI. Under heat and pressure, the thermoset composite material charge may be transformed into a low-viscosity liquid that fills the mold cavity. Then once the charge is cooled a final baffle may be formed. Other methods such as those disclosed in the Kurt Ira Butler references U.S. Pat. Nos. 5,998,510 and 5,744,816 both entitled "Low Pressure Molding Compounds" are incorporated by reference.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A loudspeaker system, comprising:

a baffle having an opening adapted to receive a transducer, where the baffle is molded from a thermoset composite material; and a wave-guide molded into the baffle adjacent to the opening and on the top side of the opening, the opening having a circular configuration such that a bottom section of the wave-guide extends along an arc substantially defined by the circular configuration of the opening adapted to receive the transducer.

2. The loudspeaker system according to claim 1, where the thermoset composite material comprises a polyester resin.

3. The loudspeaker system according to claim 2, where the polyester resin is in a styrene monomer form.

4. The loudspeaker system according to claim 1, where the thermoset composite material comprises a vinylester resin.

5. The loudspeaker system according to claim 4, where the vinylester resin is in a styrene monomer form.

6. The loudspeaker system according to claim 1, where the baffle is molded to form a wave-guide.

7. The loudspeaker system according to claim 6, where the wave-guide is a high frequency wave-guide.

8. The loudspeaker system according to claim 1, where the baffle is molded to form at least one port.

9. The loudspeaker system according to claim 1, where the thermoset composite material comprises a thick molding compound (TMC).

10. The loudspeaker system according to claim 9, where the thermoset composite material further comprises a filler.

11. The loudspeaker system according to claim 10, where the filler comprises rubber.

12. The loudspeaker system according to claim 10, where the filler comprises glass.

13. The loudspeaker system according to claim 10, where the filler comprises calcium carbonate.

14. The loudspeaker system according to claim 10, where the filler comprises mica.

15. The loudspeaker system according to claim 10, where the filler comprises wood flour.

16. The loudspeaker system according to claim 10, where the thermoset composite material further comprises a fire retarding agent.

17. The loudspeaker system according to claim 16, where the fire retarding agent comprises aluminum trihydrate.

18. The loudspeaker system according to claim 10, where the thermoset composite material further comprises a mold-releasing agent.

19. The loudspeaker system according to claim 10, where the thermoset composite material further comprises a colorizing agent.

20. The loudspeaker system according to claim 1, where the thermoset composite material comprises a sheet-molding compound (SMC).

21. The loudspeaker system according to claim 20, where the SMC further comprises a filler.

22. The loudspeaker system according to claim 21, where the filler comprises rubber.

23. The loudspeaker system according to claim 21, where the filler comprises glass.

24. The loudspeaker system according to claim 21, where the filler comprises calcium carbonate.

25. The loudspeaker system according to claim 21, where the filler comprises mica.

26. The loudspeaker system according to claim 21, where the filler comprises sawdust.

27. The loudspeaker system according to claim 20, where SMC further comprises a fire retarding agent.

28. The loudspeaker system according to claim 27, where the fire retarding agent comprises aluminum trihydrate.

29. The loudspeaker system according to claim 20, where the SMC further comprises a mold-releasing agent.

30. The loudspeaker system according to claim 20, where the SMC further comprises a colorizing agent.

31. The loudspeaker system according to claim 1, where the thermoset composite material comprises a bulk-molding compound (BMC).

32. The loudspeaker system according to claim 31, where the TMC further comprises a filler.

33. The loudspeaker system according to claim 31, where the filler comprises rubber.

34. The loudspeaker system according to claim 31, where the filler comprises glass.

35. The loudspeaker system according to claim 31, where the filler comprises calcium carbonate.

36. The loudspeaker system according to claim 31, where the filler comprises mica.

37. The loudspeaker system according to claim 31, where the filler comprises sawdust.

38. The loudspeaker system according to claim 30, where BMC further comprises a fire retarding agent.

39. The loudspeaker system according to claim 38, where the fire retarding agent comprises aluminum trihydrate.

40. The loudspeaker system according to claim 30, where the BMC further comprises a mold-releasing agent.

41. The loudspeaker system according to claim 30, where the BMC further comprises a colorizing agent.

42. The loudspeaker system according to claim 1, where the baffle is molded to form a second opening for mounting a mid range transducer.

43. A loudspeaker system, comprising:

a baffle molded from a thermoset composite material;

a wave-guide and an opening formed into the molded baffle, the opening adapted to mount a transducer, where the wave-guide molded into the baffle is adjacent to the opening and on the top side of the opening, the opening has a circular configuration such that a bottom section of the wave-guide extends along an arc substantially defined by the circular configuration of the opening adapted to receive the transducer; and a loudspeaker enclosure adapted to couple with the baffle.

44. The loudspeaker system according to claim 43, where the thermoset composite material comprises a thick molding compound (TMC).

45. The loudspeaker system according to claim 43, where the thermoset composite material comprises a sheet-molding compound (SMC).

46. The loudspeaker system according to claim 43, where the thermoset composite material comprises a bulk-molding compound (BMC).

* * * * *